United States Patent [19]

Pedersen

[11] Patent Number: 4,468,205

[45] Date of Patent: Aug. 28, 1984

[54] APPARATUS FOR SINGLE POINT MOORING

[75] Inventor: Kristen I. Pedersen, Houston, Tex.

[73] Assignee: Sofec, Inc., Houston, Tex.

[21] Appl. No.: 457,677

[22] Filed: Jan. 13, 1983

[51] Int. Cl.[3] ..... B63B 21/50

[52] U.S. Cl. ..... 441/5; 114/230

[58] Field of Search ..... 114/230, 264, 265; 441/3, 4, 5; 405/202

[56] References Cited

U.S. PATENT DOCUMENTS

| | | | |
|---|---|---|---|
| 3,464,466 | 9/1969 | Bryan | 114/230 |
| 3,690,108 | 9/1972 | Tam | 114/230 |
| 3,916,812 | 11/1975 | Bartels | 441/3 |

*Primary Examiner*—Trygve M. Blix
*Assistant Examiner*—Jesûs D. Sotelo
*Attorney, Agent, or Firm*—Dodge & Bush

[57] ABSTRACT

A single point mooring apparatus especially adapted for securing large marine tanker vessels or subsea hydrocarbon well collection and storage barges in relatively shallow water is disclosed. The floating mooring buoy structure is connected to a mooring base secured to the ocean floor by a plurality of tension leg attachment members of predetermined length. The buoyancy of the floating buoy structure is controlled to produce sufficient tension in the attachment member to provide a position restoring force to the moored marine vessel. The floating buoy structure is formed by an open frame work having a conical shape to minimize impact with ice floes on the floating buoy structure and have fully submerged buoyancy tanks to minimize the effect of wave forces and tied level variations on the position restoring force.

4 Claims, 2 Drawing Figures

APPARATUS FOR SINGLE POINT MOORING

TECHNICAL FIELD OF THE INVENTION

This invention relates to the field of mooring of marine vessels and in particular to a single point mooring system for marine vessels.

BACKGROUND OF THE INVENTION

Single point mooring systems have frequently been used in offshore locations for loading and unloading hydrocarbons or other flowable cargos into or out of marine vessels such as tankers, barges or the like. Many such systems have been developed and are now in use for both loading and unloading hydrocarbons at such offshore locations. Examples of such conventional systems include the catenary anchor leg mooring (CALM) apparatus and single anchor leg mooring (SALM) apparatus.

The catenary anchor leg mooring system (CALM) holds a floating buoy by an array or pattern of anchors attached by mooring chains or lines. The barge or tankers are attached to the floating buoy by suitable mooring ropes or a rigid mooring arm if desired. In such an anchor system, the position restoring mooring forces are provided by the horizontal force component of the mooring chains. However, in shallow water, the mooring chains cannot be arranged with sufficient slack to provide adequate resiliency or horizontal spring in the mooring system. In such instances, the horizontal movement of a moored floating vessel caused by dynamic external forces due to wave, wind and tidal currents can cause sudden extremely large forces which can exceed the capacity of the mooring system to maintain the vessel in the hydrocarbon transferring position. Because of the shallow water it was difficult to obtain the desired mooring restoring capacity to withstand these large dynamic forces without incurring the expense of additional anchors and mooring chains.

The "underwater buoy hoses" used to compensate for the vertical and horizontal motion of the buoy have been subjected to excessive curvature and bending or flexing in shallow water installations. This additional bending not only shortens the useful life of the expensive hydrocarbon transfer hose, but it also increases the risk of damage or hose failure with the attendant pollution of the water and loss of valuable hydrocarbons. Since the buoy itself floats on the sea surface, it has also been vulnerable to full impact from any passing ice floes. Therefor, the conventional CALM system is not at all suited for use in regions having large masses of floating ice.

The conventional single anchor leg mooring (SALM) uses or employs a single floating mooring buoy which is attached with a single chain or articulated arm to a lower base structure fixed to the sea bottom or floor. By submerging the buoy to a certain depth, a desired tension level is created in the anchor leg. Such tension provides a constant restoring or horizontal urging force for resiliently mooring a floating vessel to the buoy. In shallow water, the vessel position restoring capacity of the SALM mooring system is also reduced and not suitable for mooring large vessels.

Likewise, the conventional SALM system was also not particularly well suited for use in a location or region where large flow ice floes may contact or can be expected to impact the mooring buoy.

SUMMARY OF THE INVENTION

The present invention provides a single point mooring system that is particularly suited for use in mooring large vessels in relatively shallow water. In addition, the buoy mooring structure is arranged to minimize any damaging impact from floating ice to enable use in the marine environment where ice floes may be encountered.

The single point mooring system of the present invention utilizes a base which is secured or anchored to the sea bed or ocean floor by conventional methods or techniques. The mooring buoy structure is secured to the base by a plurality of attaching tension leg members which are arranged to enable limited relative movement between the buoy and the fixed base. The tension legs are dimensioned so that the buoyancy of the buoy structure will maintain the legs under constant tension to maintain the resiliency or restoring force of the buoyancy system. The buoy structure is formed by a circular or ring-shaped base member having a set of circumferentially spaced radial support members extending inwardly and upwardly to an apex to provide a conical shaped frame for the main body portion. The apex mounts a rotatable marine vessel attachment portion or structure for securing to the moored vessel such as by lines or a rigid vessel attachment structure. The essentially open frame structure of the buoy structure minimizes the effect of wind, waves and tide on the buoy structure. The circular shaped base of the buoy structure and the sloping orientation of the radial members of the conical shaped frame provides maximum resistance to impact or damaging contact with ice floes by breaking up the ice floes and enabling the debris to slide past the buoy structure. The buoy structure is supported by the uplift supplied by large buoyancy tanks located below the conical shaped frame of the buoy structure. The buoy structure positions the buoyancy chambers at a protected preselected submerged depth within the mooring apparatus to provide constant uplift, generally unaffected by surface wave action and to avoid contact with ice floes.

The buoy structure is secured to the fixed base by a plurality of attaching tension leg members which are arranged to enable relative movement between the base and the buoy. The length of the tension legs are dimensioned so that the buoyancy tanks under the buoy structure maintains the legs under tension at all times to provide a steady but resilient restoring force to keep the moored vessel on station irregardless of surface wave action or normal tidal changes in water level.

DETAILED DESCRIPTION OF THE PREFERRED EMBODIMENT

Figure 1:
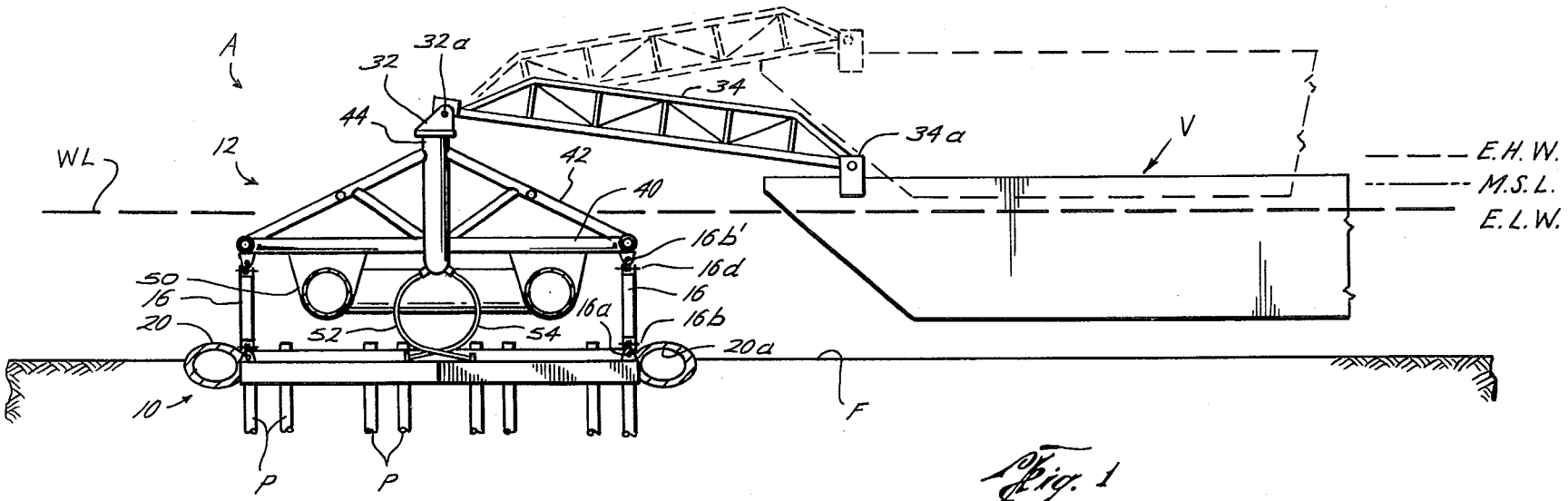
FIG. 1 is a side view, partially in section, of the single point mooring apparatus of the present invention illustrating the range of vertical movement of a marine vessel relative to the single point mooring system.

The single point marine vessel mooring apparatus of the present invention, generally designated A is best illustrated in the operating condition in FIG. 1. The single point mooring system A is normally used at offshore locations for loading and unloading hydrocarbons or other flowable cargos into or out of marine vessels V such as tankers, barges or the like. In addition, the mooring system apparatus A may be used as the production storage facility for subsea completions of oil and gas wells. In such instances, the subsea completed well (not illustrated) would be connected to the mooring apparatus A by suitable flow line or piping (also not illustrated) for conducting the produced hydrocarbons to the marine vessel V for collection prior to transshipment, and also allow control of the wellhead(s) via hydraulic or electric control lines (not illustrated) from the marine vessel through the mooring apparatus to the wellhead(s).

The mooring apparatus A of the present invention includes a mooring base 10 connected to a floating mooring buoy structure, generally designated 12, by a plurality of tension leg attachment members 16. The base 10 may be formed in any suitable shape, but in the illustrated embodiment (FIG. 2), a square tubular frame 20 is utilized. Suitable diagonal cross bracing 22 as well as corner support flanges 24 may be provided to give the base 10 sufficient strength and rigidity for the operating conditions anticipated or predicted for the mooring apparatus A. Because the mooring apparatus A of the present invention is particularly well suited for use in mooring large marine vessels V in relatively shallow water, the base 20 will normally be a massive structure in order that a large plurality of piles P may be put in place to secure the base B to the ocean floor F in the conventional manner. Normally, the frame 20 is provided with sufficient hollow chambers 20*a* in order that the frame 20 may be floated from the fabrication site to the location where it is desired to install the mooring apparatus A of the present invention.

The floating mooring buoy structure 12 includes a main body portion, generally designated 30, and a marine vessel attachment portion 32 rotatably mounted therewith above the water level WL. The turntable mounting of the marine vessel attachment portion 32 enables the marine vessel V to swing about the mooring buoy apparatus A in the conventional manner to minimize the effects of wind, tide, waves or other envoronmental conditions on the vessel V. In the illustrated embodiment the attachment portion 32 is pivotly connected to a rigid mooring arm 34 which is permanently connected to the marine vessel V by hinge or pivot connections at 34*a*. It being understood to those skilled in the art, that the mooring connections between the turntable 32 and the vessel V may be made by suitable lines. However, the illustrated embodiment contemplates the marine vessel V being secured continuously to the mooring apparatus A to serve as a hydrocarbon production storage facility for subsea hydrocarbon producing wells so the rigid arm 34 is illustrated. The pivoting connections 34*a* of the arm to the marine vessel V and at pivot connection 32*a* with the attachment portion 32 of the mooring apparatus A enables the marine vessel V to rise and fall with changes in the water level and the changing draft of the vessel V by loading and storage of hydrocarbons without imparting undue stresses to the mooring apparatus A. Attachment portion 32 also contains a longitudinal pivot axis, perpendicular to pivot connection 32*a*, which permit roll movements of the rigid arm or yoke 34 and of the attached marine vessel V. The rigid arm or yoke 34 may be used to permanently or intermittently moor the marine vessel V.

Figure 2:
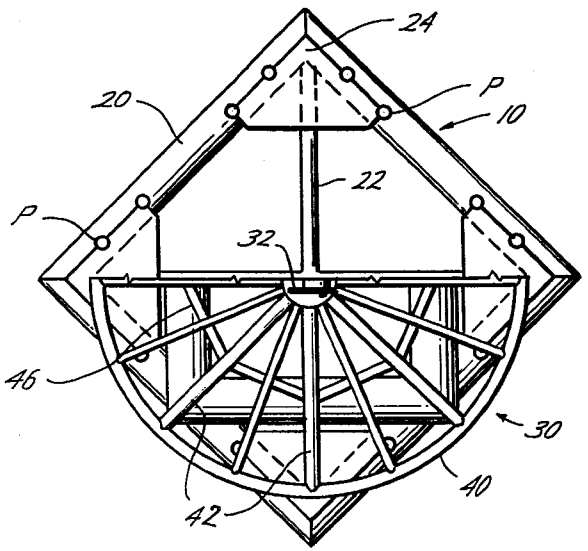
FIG. 2 is a top view of the single point mooring apparatus bisected to show in one half the fixed securing base and in the other half both the floating buoy structure and securing base.

As best illustrated in FIG. 2, the main body portion 30 of the mooring buoy structure includes a horizontal circular or ring-shaped base member 40. A plurality of support members 42 have their lower end secured to the circular base member 40 and extend upwardly and inwardly therefrom to join at an apex provided by a vertical tubular housing member 44 that is concentrically positioned relative to the base member 40. The central vertical member 44 also rotatably mounts the marine vessel single point mooring attachment portion 32 to enable the vessel V to swing about the apparatus A as will be well understood by those skilled in the art. Suitable cross bracing 46 is provided between the upwardly tapered support members 42 to provide sufficient rigidity to the resulting conical shaped frame of the main body portion 30. The attachment members 42 are preferably equi-circumferentially spaced about the base member 40 to provide a sufficient opening therebetween to enable the passage of wind and tidal currents to minimize their effect, as well as that of wave action, on the floating buoy structure 12. In addition, the conical shaped frame of the main body portion 30 provides an upwardly tapering surface for engaging or contacting floating ice for diverting the ice away from and around the mooring apparatus A and to minimize any damage from impact or contact with the ice.

Mounted with the main body portion 30 are buoyancy tanks 50 which are positioned within and below the base ring 40 to provide constant buoyancy and to protect the buoyancy tanks 50 from contact with the ice floes or other objects which could damage or rupture the buoyancy tanks 50. When unrestrained by the four attachment arms 16, the mooring buoy structure and buoyancy tanks will float on the water surface. However, when the plurality of four attachment arms 16 are operably installed the submergence depth of the buoyancy tanks 50 is adjusted such that the attachment legs 16 restrain or hold the buoyancy tanks 50 well below the wave agitated water surface. This induces a constant tension force loading in the attachment members 16 for providing a steady but resilient urging or restoring force to keep the moored marine vessel V on station in spite of the surge, roll, pitch and heave motions imparted to the moored vessel by wind, wave and currents.

As best illustrated in FIG. 1, each of the parallel attachment members 16 are pivotly connected at their lower end to the base 10 by pivot pins 16*a* and 16*b*. Likewise, the upper end of each of the attachment members 16 are pivotly secured to the main body portion 30 of the mooring buoy structure 12 by pivot pins 16*c* and 16*d*. The pivoting connection provided by the attachment members 16 enables relative motion of the mooring buoy structure 12 in any horizontal direction relative to the fixed base 10. Because of the restrained buoyancy of the buoyancy tanks 50 in the main body portion 30 of the mooring buoy structure 12 caused by the tension leg attachment members 16, the mooring buoy structure 12 will return to the same relative position to the base 10 whenever the horizontal force applied to the mooring buoy structure to effect movement is removed.

To transfer the liquid cargos to and from the mooring apparatus A of the present invention a conventional fluid swivel is provided between the vertical member 44 and the rotatable marine vessel attachment portion 32. Suitable piping or hoses (not illustrated) may be used to connect the attachment portion 32 to the marine vessel V in the conventional manner. Likewise, submerged flexible hoses 52 and 54 connect the lower portion of the central tubular member 44 containing the fluid swivel (not illustrated) with the base 10 of the mooring apparatus A. The hoses 52 and 54 enable the limited horizontal movement of the mooring buoy structure 12 relative to the base 10 but are held against excessive deflection and wear due to the constant tension loading of the arms 16 which tend to stabilize the buoy structure 12 relative to the base 10. Rigid piping with intermittent swivel joints could be utilized in lieu of flexible hoses if desired.

Use And Operation Of The Present Invention

In the use and operation of the present invention, the mooring apparatus A is fabricated and installed in the manner illustrated. After the base 10 is secured to the ocean floor F by the plurality of piles P, the buoy structure 12 is lowered in place with the buoyancy tanks 50 ballasted with water and the attachment members 16 are connected between the base 10 and the mooring buoy structure 12. The buoyancy of the mooring buoy structure 12 is then controlled by dewatering the buoyancy tanks 50 to induce the tension loading in the attachment members 16 to provide the position restoring force to the marine vessel V. In the illustrated embodiment, the rigid permanent mooring yoke or arm 34 is installed as well as the permanently moored vessel V. It being well understood, that the single point mooring apparatus A of the present invention may be used to intermittently secure vessels V for loading or unloading without departing from the scope or spirit of the present invention.

The flow piping is connected to the base 10 and through hoses 52 and 54 or through articulated piping on the swivel mounted with the vertical member 44. The hydrocarbons are then communicated through the swivel to a flow line positioned on the rigid mooring arm 34 where it is carried to the marine vessel V in the conventional manner. Flow direction may be either to or from the marine vessel V as desired depending on the desired use of the apparatus A of the present invention.

The opened frame conical shape of the main body portion 30 of the mooring buoy structure 12 minimizes the effect of environmental conditions on the mooring apparatus A. In addition, the upwardly taper of the spaced apart members 42 tends to divert ice floes from the apparatus A and minimize the damaging effect of their impact on the apparatus A as well as from moored marine vessel V.

The foregoing disclosure and description of the invention are illustrative and explanatory thereof, and various changes in the size, shape and materials, as well as in the details of the illustrated construction may be made without departing from the spirit of the invention.

What is claimed is:

1. Apparatus adapted for mooring a floating marine vessel to the ocean floor in an area of relatively shallow water depth, including:

a mooring base for securing to the ocean floor at a desired location for mooring the floating marine vessel, a mooring buoy structure having a main body portion and a marine vessel attachment portion for securing with the marine vessel, said main body portion having supporting buoyancy tanks which are submerged well below the surface wave zone, said marine vessel attachment portion rotatably mounted with the main body portion above the water level to enable the moored floating marine vessel secured therewith to swing about said main body portion of said mooring buoy structure to minimize the effects of wind, tide or waves on the marine vessel;

a plurality of attachment members disposed in a substantially parallel relationship for operably connecting said main body portion of said mooring buoy structure to said base while enabling limited relative movement between said base and said buoy structure, each of said arms of a predetermined length for maintaining said main body portion at a depth in the water which places the supporting buoyancy tanks well below surface wave action and tidal water level variations so as to induce a constant tension loading in the attachment arms to provide a steady vessel position restoring force to said main body portion of the buoy structure;

said main body portion of said mooring buoy structure having a ring-shaped base member and a plurality of radial support members, said radial support members secured at one end with said base member and extending upwardly and inwardly to form an apex to provide a generally conical shaped frame for said main body portion.

2. The apparatus as set forth in claim 1 wherein, said upwardly extending radial support members are circumferentially spaced on said base member to provide sufficient open area between said support member to minimize the effect of wind, waves and tide on the floating buoy structure.

3. The apparatus as set forth in claim 1, wherein:

said radial support members are sloped to break up approaching ice floes as they ride up upon the sloping members and thus minimize the damaging impact of passing ice floes on said mooring buoy structure.

4. The apparatus as set forth in claim 1, wherein:

means for controlling the buoyancy of said mooring buoy structure including one or more fully submerged buoyancy tanks are mounted with said main buoy portion within said ring-shaped base member to protect said buoyancy tanks from undesired impact with ice floes.

* * * * *